US010843913B2

(12) United States Patent
Mutterle

(10) Patent No.: US 10,843,913 B2
(45) Date of Patent: Nov. 24, 2020

(54) METHOD FOR SEALINGLY CLOSING A BOTTLE AND ASSOCIATED SEALINGLY CLOSED BOTTLE

(71) Applicant: Antonio Mutterle, Breganzona (CH)

(72) Inventor: Antonio Mutterle, Breganzona (CH)

(73) Assignee: ALTERGON SA, Lugano (CH)

( * ) Notice: Subject to any disclaimer, the term of this patent is extended or adjusted under 35 U.S.C. 154(b) by 254 days.

(21) Appl. No.: 15/317,434

(22) PCT Filed: Jun. 17, 2015

(86) PCT No.: PCT/IB2015/054579
§ 371 (c)(1),
(2) Date: Dec. 9, 2016

(87) PCT Pub. No.: WO2015/193830
PCT Pub. Date: Dec. 23, 2015

(65) Prior Publication Data

US 2017/0121163 A1 May 4, 2017

(30) Foreign Application Priority Data

Jun. 18, 2014 (IT) ..... MI2014A1102

(51) Int. Cl.
*B67B 1/08* (2006.01)
*A61J 1/14* (2006.01)
(Continued)

(52) U.S. Cl.
CPC ..... *B67B 1/08* (2013.01); *A61J 1/1406* (2013.01); *B65D 39/0052* (2013.01); *B65D 45/322* (2013.01); *B65D 51/002* (2013.01)

(58) Field of Classification Search
CPC .... B67B 1/08; B65D 39/0052; B65D 45/322; B65D 51/002; A61J 1/1406
(Continued)

(56) References Cited

U.S. PATENT DOCUMENTS 5,299,702 A * 4/1994 Kneer ..... B65D 39/16 215/256
5,813,554 A * 9/1998 Marangoni Graziani ..... B65D 45/322 215/274
(Continued)

FOREIGN PATENT DOCUMENTS

CA 2 577 886 A1 8/2008
FR 2 927 316 A1 8/2014
(Continued)

OTHER PUBLICATIONS

International Search Report dated Sep. 30, 2015 in PCT/IB2015/054579 filed Jun. 17, 2015.

*Primary Examiner* — Thanh K Troung
*Assistant Examiner* — Katie L Gerth
(74) *Attorney, Agent, or Firm* — Oblon, McClelland, Maier & Neustadt, L.L.P.

(57) ABSTRACT

A method for sealingly closing a bottle (1) is described, the method comprising the steps of: providing a cage (1009, a closing stopper (200) and a capsule (300); joining the stopper to the cage and the cage to the capsule (300), obtaining a preassembled closing assembly; aligning the closing assembly on the mouth of the bottle and exerting a pressure so as to sealingly close the bottle, wherein the annular relief of the cage (100) comes into contact with the bottle before the stopper comes into contact with the bottle.

13 Claims, 7 Drawing Sheets

(51) Int. Cl.
*B65D 45/32* (2006.01)
*B65D 51/00* (2006.01)
*B65D 39/00* (2006.01)

(58) Field of Classification Search
USPC ..... 53/420; 215/299, 50, 54, 296, 364, 360, 215/356, 355, 329, 316, 228; 220/802, 220/801, 212, 324, 315
See application file for complete search history.

(56) References Cited

U.S. PATENT DOCUMENTS 5,957,314 A * 9/1999 Nishida ..... B65D 45/322 215/249
8,627,970 B2 * 1/2014 Macy ..... A61B 5/150351 215/228
8,684,204 B2 * 4/2014 Belle ..... B65D 51/002 215/274
2010/0050575 A1 * 3/2010 Aneas ..... B65D 41/28 53/485
2011/0000872 A1 1/2011 Aneas
2012/0187072 A1 * 7/2012 Belle ..... B65D 51/002 215/274
2012/0248057 A1 * 10/2012 Bogle ..... A61J 1/1406 215/43
2013/0240476 A1 * 9/2013 Aneas ..... B65D 51/002 215/320
2013/0312373 A1 11/2013 Bogle et al.
2014/0034646 A1 * 2/2014 Lanier ..... B65D 51/002 220/361

FOREIGN PATENT DOCUMENTS

WO 2011/039004 A1 4/2011
WO 2015/082354 A1 6/2015

* cited by examiner

METHOD FOR SEALINGLY CLOSING A BOTTLE AND ASSOCIATED SEALINGLY CLOSED BOTTLE

The present invention relates to the sector of systems for sealingly closing a container, for example a bottle. In particular, the invention relates to a method for sealingly closing a bottle or a similar container. The present invention also relates to a bottle sealingly closed using the aforementioned method. The invention is applicable to bottles containing powders of varying kinds, injectable liquids, drinkable liquids or the like.

BACKGROUND ART

For the sake of simplicity, the present invention will be described substantially only with reference to a particular type of container, a bottle. However, the present invention is not limited only to these containers and the choice of referring only to bottles is not to be understood in any way as limiting the scope of protection of the invention.

Moreover, although a possible field of application is the pharmaceutical field, the present invention is also applicable to other (related or different) fields, for example the cosmetic sector, the food sector, the sector of food supplements or any other sector where it is required to place a substance in a safe and sealed manner inside a container.

US 2011/0000872 A1 describes a stopper device comprising a support stopper and a container provided with such a device.

WO 2011/039004 A1 describes a locking stopper for a bottle, which includes a stopper with fastening tongues.

CA 2 577 886 A1 describes a plug without an inserted seal.

FR 2 927 316 describes a closing assembly for a bottle. In such a solution, the assembled closing assembly is associated with the bottle by inserting the closing stopper inside the mouth of the bottle.

BRIEF SUMMARY OF THE INVENTION

The Applicant has noted that the stopper device according to US 2011/0000872 A1 involves firstly partially inserting the stopper 2 inside the bottle mouth and then mounting the other components on the stopper. However, the stopper inserted inside the bottle mouth is not stable and rarely is aligned with the axis of the bottle. This makes the closing assembly unstable and there is the risk of not being able to exert correctly the pressure required to sealingly close the bottle. Moreover, the device as a whole may not be preassembled.

The locking stopper described in WO 2011/039004 A1 also involves inserting the stopper into the mouth of the bottle before sealingly closing it by exerting a certain pressure on the sealing assembly.

The Applicant has found in tests that the closing assembly described in FR 2 927 316 involves sealing the bottle in two separate and successive stages, in a similar or identical manner to the closing systems already currently present on the market (for example aluminium sealing stoppersules). The sole difference determined between the closing system described in FR 2 927 316 and the systems which are currently commercially available is that with the first solution sealing is performed by means of pressure while with the latter it is performed by means of rolling. Moreover, the diameter of the closing assembly according to FR 2 927 316 in most cases is greater than the diameter of the body of the bottle on which it is mounted and this creates major problems of instability during the labelling stage, during storage and during transport in the case where said bottles are moved alongside each other on high-speed production lines, consequently limiting use thereof.

The object defined by the Applicant is to provide a method for sealingly closing a bottle by means of a simple and reliable closing assembly which may be preassembled and sealed with respect to the bottle by means of pressure in a single operation.

The present invention provides a method for sealingly closing a bottle by means of a closing assembly with a cage configured so as to have a device for retaining a closing stopper and prevent it from being separated from the cage and with an inner relief configured so as to engage with the bottom edge of the collar of the bottle once closing has been completed. The preassembled closing assembly is pressed directly onto the mouth of the bottle without an intermediate step during which the stopper is partially inserted inside the mouth of the bottle.

According to a first aspect, the present invention provides a method for sealingly closing a bottle, the method comprising the steps of:

- providing a cage, a closing stopper and a capsule, wherein:
  - said cage is substantially cup-shaped and comprises a side wall with an inner surface comprising an annular relief;
  - said capsule is cup-shaped and comprises a side wall which terminates in a free edge;
  - the inner surface of the side wall of the cage comprises an elastic retaining element for retaining the closing stopper in position;
- joining the stopper to the cage and the cage to the capsule, obtaining a preassembled closing assembly;
- aligning the closing assembly on the mouth of the bottle and
- exerting a pressure so as to sealingly close the bottle, wherein the annular relief of the cage comes into contact with the bottle before the stopper comes into contact with the bottle.

The step of joining the stopper to the cage comprises the step of pushing the stopper towards a base of said cage, forcing said elastic retaining element to retract inside a recess.

The step of joining the cage to the capsule comprises the step of providing a first engagement element in the capsule and a first engagement element in the cage and the step of engaging said first engagement elements with each other.

The first engagement element of the capsule may be disengaged from said first engagement element of the cage by exerting pressure towards the bottom of the bottle.

After exerting pressure in order to sealingly close the bottle, the first engagement element of the capsule engages with a second engagement element of said cage.

The step of joining the stopper to the cage is preferably performed by keeping the open base of the cage directed upwards.

Preferably, a substance is introduced into said bottle before aligning the closing assembly on the mouth of the bottle and before exerting pressure so as to sealingly close the bottle.

In one embodiment, the substance is a substance in the liquid state.

According to another aspect, the present invention envisages a bottle sealingly closed using the method described above.

A detailed description of the invention now follows, being provided purely by way of a non-limiting example, to be read with reference to attached sets of drawings in which.

In the description which follows, all the position terms such as "top" or "upper", "bottom" or "lower", "side" or "lateral", etc., are used with reference to the figures. However, a component qualified as "top" or "upper" (because it is shown in an upper position with respect to others) may be "bottom" or "lower" if turned upside down or rotated in another position. Therefore, these terms are not to be regarded as limiting the scope of protection. Typically, during assembly, some components may be overturned with respect to their position at the end of assembly or during use.

Figure 1:
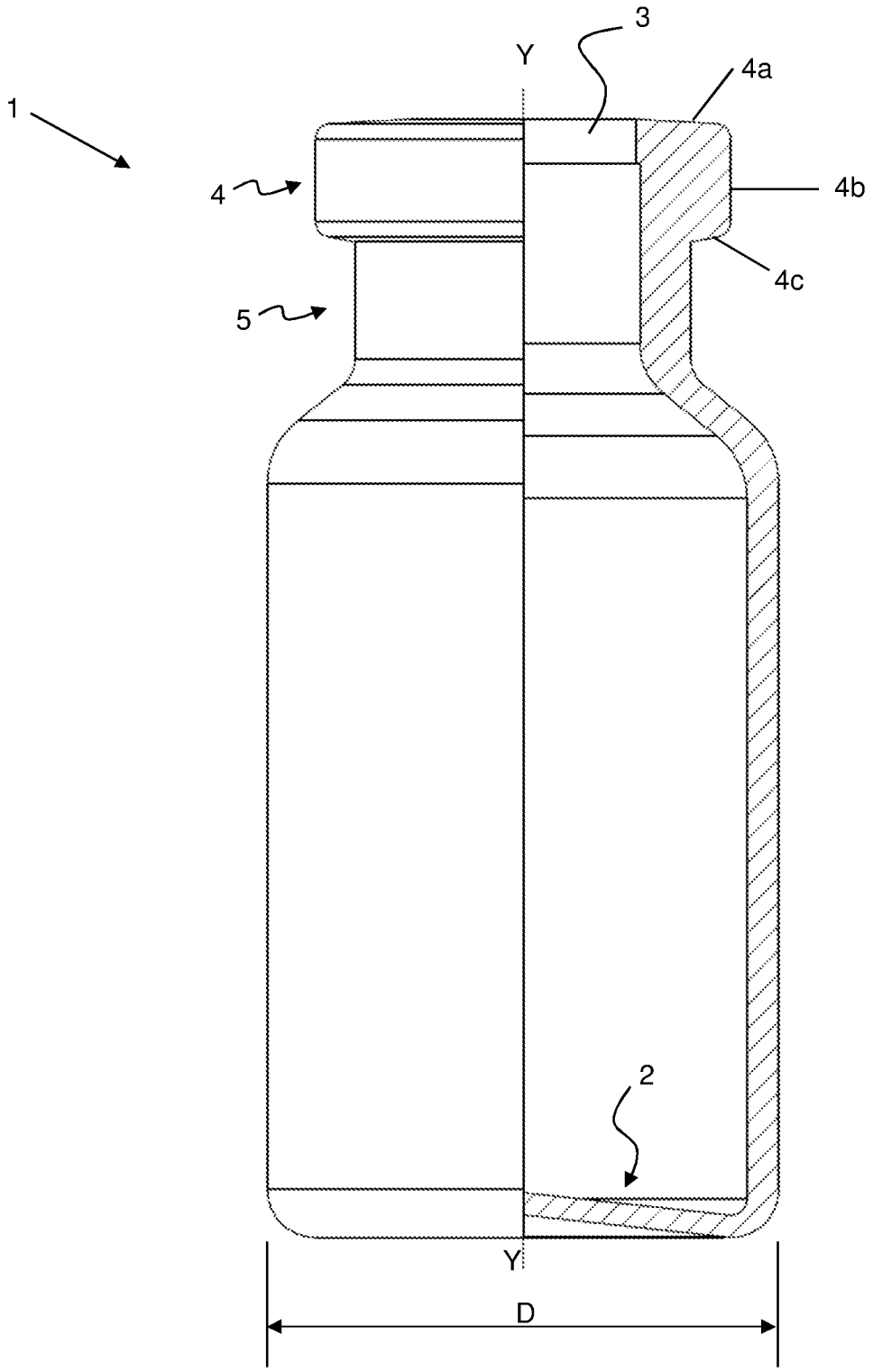
FIG. 1 shows, longitudinally sectioned, a bottle configured to be closed by means of the closing assembly according to embodiments of the present invention.
Figure 2:
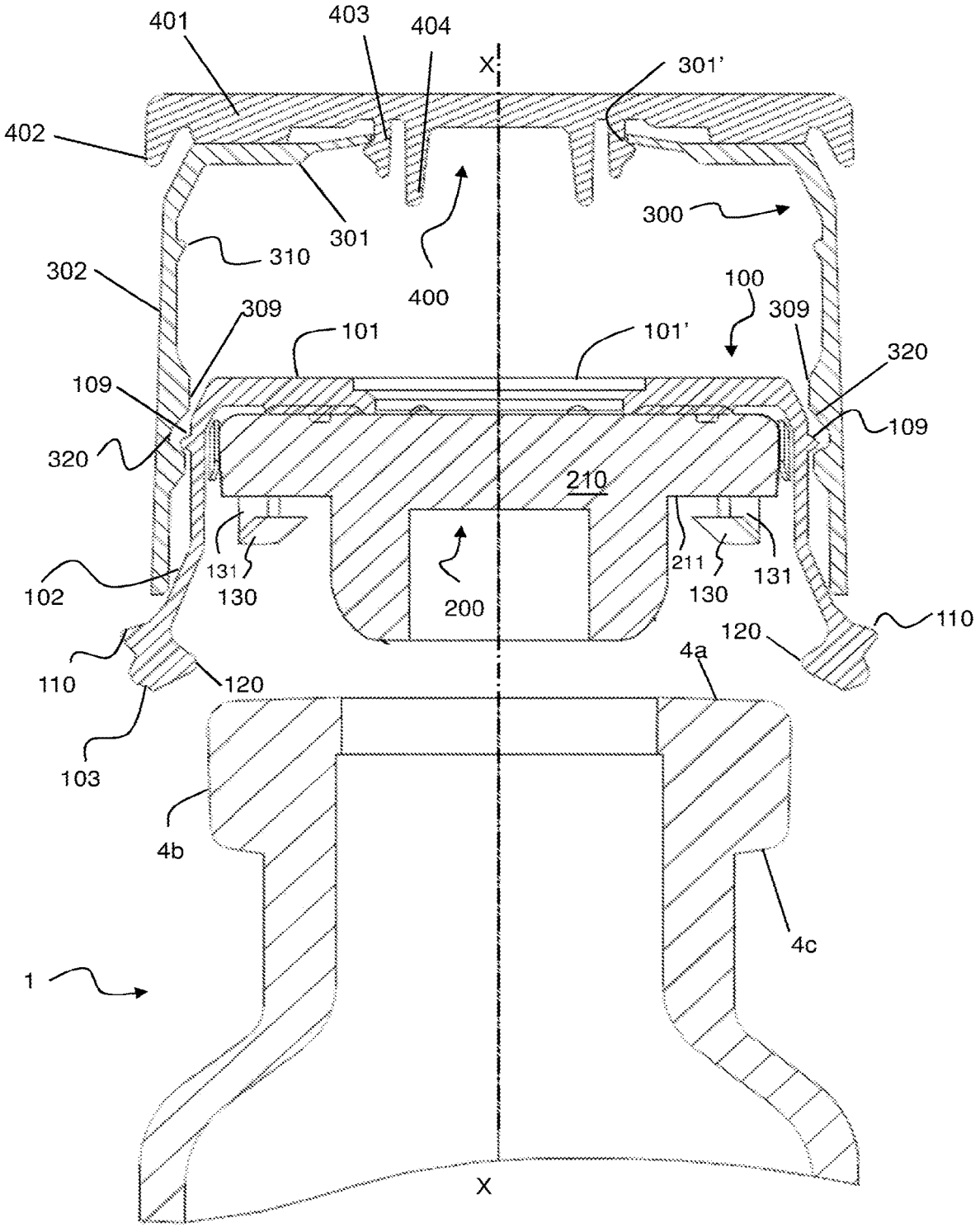
FIG. 2 shows, in a longitudinally sectioned larger-scale view, the closing assembly according to a first embodiment of the present invention, preassembled, at the start of the closing process.
Figure 3:
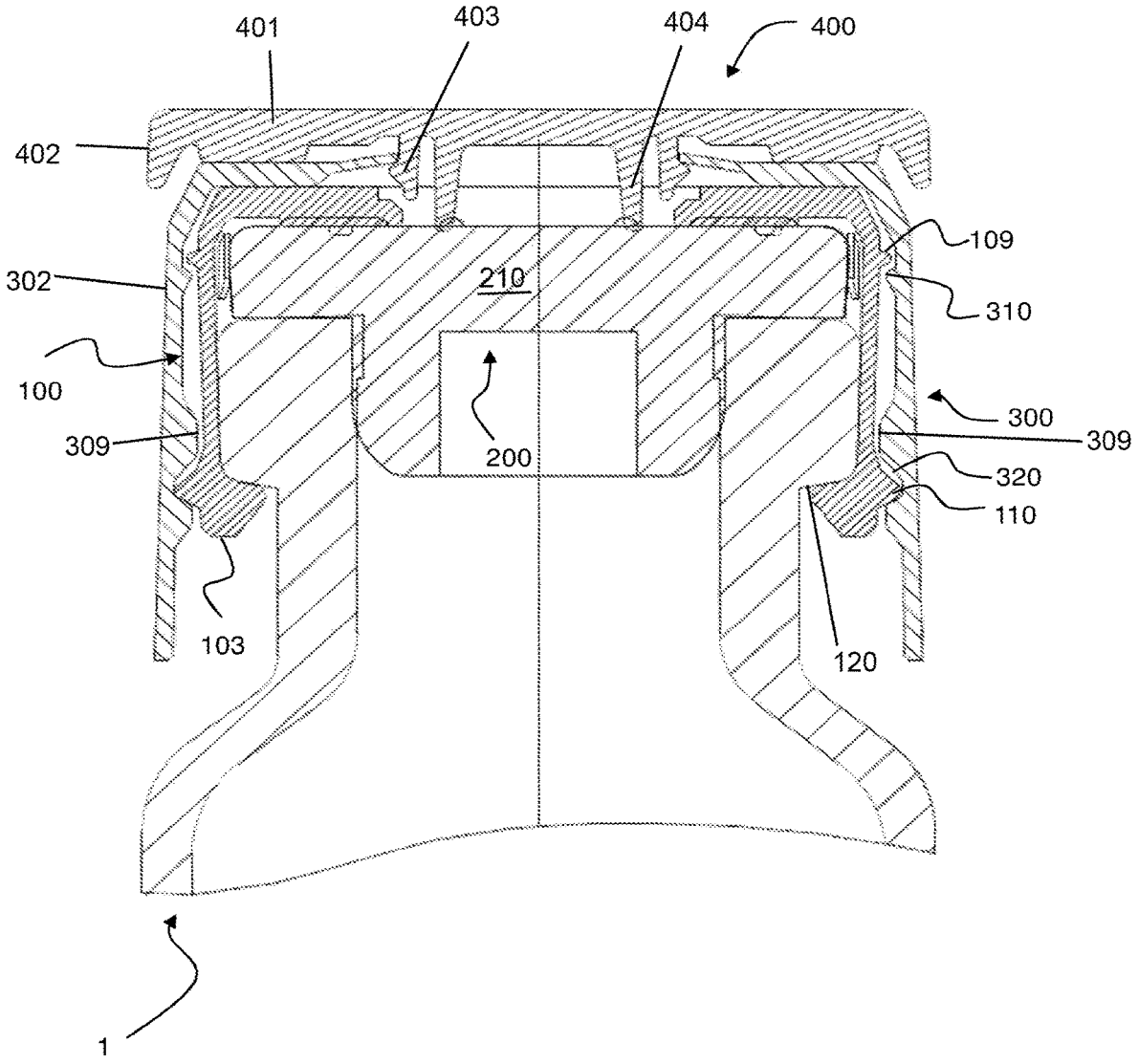
FIG. 3 shows, in a longitudinally sectioned larger-scale view, the closing assembly according to FIG. 2 at the end of the closing process.

With reference initially to FIG. 1, the bottle 1 comprises a substantially cylindrical body with a closed bottom 2 and an open mouth 3. An annular collar 4, namely a ring-like collar which forms an enlarged part extending radially outwards, is preferably provided in the region of the mouth 3. A neck 5 with an outer diameter smaller than that of the collar 4 is formed underneath the collar 4 and is connected to the bottom part of the substantially cylindrical body. Such a bottle is also conventionally known as a "penicillin phial". More precisely, as also shown in FIGS. 2 and 3, the annular collar 4 comprises a top surface 4*a* which is substantially horizontal (in reality it is slightly inclined downwards in the outward direction), a substantially vertical side surface 4*b* and a bottom surface 4*c* slightly inclined upwards in the outward direction. The various top, side and bottom surfaces are connected together by means of curved surfaces. Preferably, the bottle is made of glass or a plastic material such as polyethylene, polyethylene terephthalate, PETG, PETE, PEHD, COC (Cyclic Olefin Copolymer) or the like.

A first type of closing assembly, which can be used with the method according to the present invention, is shown in FIGS. 2 and 3. Hereinbelow the cage 100, the sealing stopper 200, the capsule 300, and the protection cap 400 will be described separately. Thereafter the mutual relationship of the various components and how to assemble them will be described.

With reference to FIGS. 2 and 3 the cage 100 will now be described. The cage 100 is in the form of an overturned cup-shaped body with a closed top base 101 (apart, possibly, for an opening 101' which will be described below) and a side wall 102 which terminates in a free edge 103. Preferably, the side wall 102 is divided up into a plurality of substantially parallel, separate, side walls which are connected together at the closed base 101. A groove is present between each separate side wall. According to a preferred embodiment, the side wall is divided up into eight separate side walls.

Preferably, the inner surface of the side wall 102 of the cage 100 comprises a lower annular relief 120, preferably in the vicinity of the free edge 103. The lower annular relief 120 forms, in cross-section, a kind of nose radially projecting towards the axis X-X of the cage 100.

In one embodiment, the outer surface of the side wall 102 of the cage comprises preferably an upper annular spur 109 and a lower annular spur 110. The upper spur 109 is preferably in the vicinity of the closed base 101. The lower spur 110 is preferably substantially opposite to the lower annular relief 120.

Preferably, the inner surface of the side wall 102 of the cage 102 comprises an elastic retaining element, which may be in the form of one or more flexible retaining teeth 130 (for example four teeth) for retaining in position the stopper 200 which will be described below. Each retaining tooth 130 projects in cantilever fashion and is inclined with respect to the inner surface of the side wall 102 of the cage 100. The degree of inclination of the aforementioned teeth may vary depending on the requirements for use.

Preferably each tooth 130 is provided with a recess or niche 131 inside which the tooth 130 may be retracted. In this way, as will become clear below, the stopper 200 may be pushed towards the base 101 of the cage 100 and retained in the vicinity thereof. During this step, the teeth 130 retract elastically inside the respective recesses or niches 131 and then return into their initial projecting position. If necessary, the aforementioned teeth 130 may be modified in terms of their form and inclination so that, in addition to retaining the stopper, they may also ensure centring of the stopper inside the cage 100 in order to allow correct positioning thereof on the mouth of the bottle.

Preferably, the upper base 101 of the cage comprises a hole 101'. Preferably, the hole 101' in the upper base of the cage is a central circular hole.

Preferably, the cage 100 is made of a thermoplastic material and is produced by means of injection-moulding as one piece. A suitable material is, for example, polyethylene, polyethylene terephthalate, PETG, PETE, PEHD, COC, ABS (Acrilonitrile Butadiene Styrene) or the like.

FIGS. 2 and 3 show also, by way of a non-limiting example, a sealing stopper 200. Alternatively, included within the scope of protection of the present invention, the sealing stopper could be formed only by the head 210, in the form of a relatively thick disc.

Preferably, the sealing stopper 200 is made of rubber or a similar material. The stopper 200 forms a sealing surface 211 designed to cooperate with the upper surface 4*a* of the collar 4 of the bottle, so as to ensure the sealing action.

With reference to FIGS. 2 and 3 the capsule 300 will now be described. The capsule 300 has preferably the shape of an overturned cup with an upper base 301 which is substantially closed and a side wall 302 which terminates in a free edge. Preferably, the capsule 300 is made of a plastic material, but could also be formed from metallic material such as aluminium or aluminium alloy.

Preferably, the side wall 302 of the capsule 300 comprises a first annular projection 309, a second annular projection 310, and an annular cavity 320. The function of the first projection 309, the second projection 310, and the cavity 320 will be explained below.

The upper base 301 of the capsule may comprise a central opening 301', which is advantageously substantially circular.

According to the various embodiments known and present on the market a protection cap 400 is joined together with the upper base 301 of the capsule 300, as shown in FIGS. 2 and 3. As shown in FIG. 3, the annular relief 120 of the cage 100 can engage with the bottom surface of the collar, the annular cavity 320 can engage with the lower annular spur 110, the upper annular spur 109 of the cage 100 can be above and adjacent to the second annular projection 310 of the capsule 300, and the closing assembly can remain locked to the bottle. The cap 400 can be removed from the capsule 300 by levering it upwards, also using only the fingers of a hand. The cap 400 is preferably made of a plastic or thermoplastic material such as polyethylene, polyethylene terephthalate, PETG, PETE, or PEHD or the like. When the cap 400 is removed by the user a part of the top surface of the head 210 of the sealing stopper 200 remains exposed, as defined by the hole 101' of the cage 100 and the hole 301' of the capsule 300. The sealing stopper 200 may thus be pierced, for example, by a needle of a syringe so as to introduce into the bottle a certain amount of a liquid (for example a solvent) and then draw off the solvent with the solute.

The cap 400 preferably comprises a circular disc 401 with a rim 402 shaped so as to surround a part of the side wall 302 of the capsule 300. Preferably, the external diameter of the cap 400 is smaller than the diameter of the bottle. The cap 400 comprises preferably an engaging part 403 for engagement with the edge of the central opening 301' in the upper base 301 of the capsule 300. The cap 400 may also comprise a further projection 404 configured to penetrate until it touches the head 210 of the sealing stopper 200 such as to ensure the cleanliness and if necessary sterility thereof at the piercing point. The characteristic features of the cap 400 may vary in shape and type of engaging system depending on the requirements.

Figure 4:
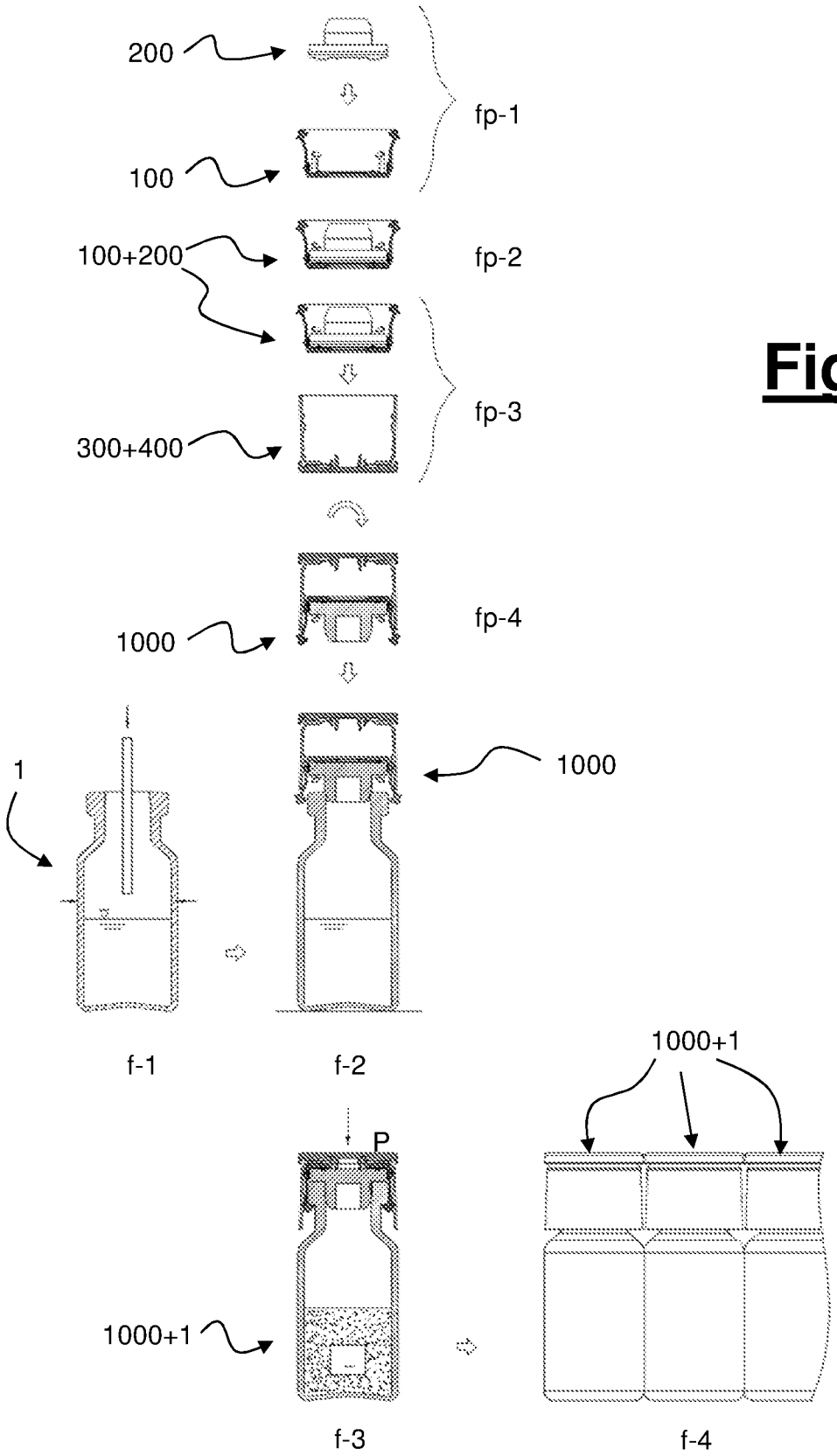
FIG. 4 shows the sequence of steps for preassembly of the closing assembly according to FIGS. 2 and 3, filling the bottle, and closing and transporting and/or storing filled bottles.

With reference to FIG. 4 and FIGS. 2 and 3, one of the many ways by means of which the closing assembly may be preassembled is now described. The subsequent steps of sealingly closing the bottle by means of the closing assembly according to the invention are also described.

During the preassembly step fp-1, the sealing stopper 200 is associated with the cage 100. Preferably the sealing stopper 200 has its shank directed upwards and the cage 100 is placed with the free edge 103 directed upwards so as to receive the head 210 of the sealing stopper 200. During insertion of the stopper head 210, the retaining teeth 130 retract inside the respective recesses 131 and then snap back out so as to retain the sealing stopper 200 in position, as shown in the step fp-2.

Then (step fp-3), the cage 100 (together with the sealing stopper 200) is inserted partially inside the capsule 300. This step is preferably performed while still keeping the cage 100 (together with the sealing stopper 200) directed upwards. The cage 100 is only partially inserted inside the capsule 300 so that the annular spur 109 is seated inside the annular cavity 320.

Preferably, before partially inserting the capsule 300 onto the cage 100, the cap 400 has already been associated with the capsule 300.

The assembled closing assembly 1000, comprising the cage 100, the sealing stopper 200, the capsule 300, and the cap 400, is placed inside a container, such as bottle 1 which, if necessary, may then be used for sterilization.

Before or after the aforementioned preparatory steps, during a step f-1, the bottle is at least partially filled with a substance. This substance may be any substance in any state. For example, an injectable liquid substance, a drinkable liquid substance, a powder, etc.

The steps f-2 and f-3 consist in reality of a single step, but are shown as being separate for greater clarity. In step f-2 the closing assembly 1000 is fitted onto the bottle 1 in such a way that the end relief 120 presses elastically against the side surface of the bottle collar, as shown in FIG. 2. It should be noted that, when the end relief 120 comes into contact with the bottle collar, the stopper has not yet penetrated into the mouth of the bottle and substantially does not make contact with it. Therefore the stopper does not play a part in stabilization of the closing assembly as in the known solutions. Moreover, differently from the known solutions, the cage is not mounted on the stopper inserted inside the bottle, but pressure is applied to the preassembled closing assembly.

During step f-3 a pressure directed downwards is exerted on the stopper and therefore on the entire closing assembly. In particular, the pressure P exerted is such that the bottom annular relief of the cage engages with the bottom surface of the collar and the closing assembly remains locked to the bottle.

The step f-4 shows that the bottles may be handled such that they are straight when arranged next to each other since the diameter of the closing assembly 1000 is smaller than the diameter of the bottle body.

Figure 5:
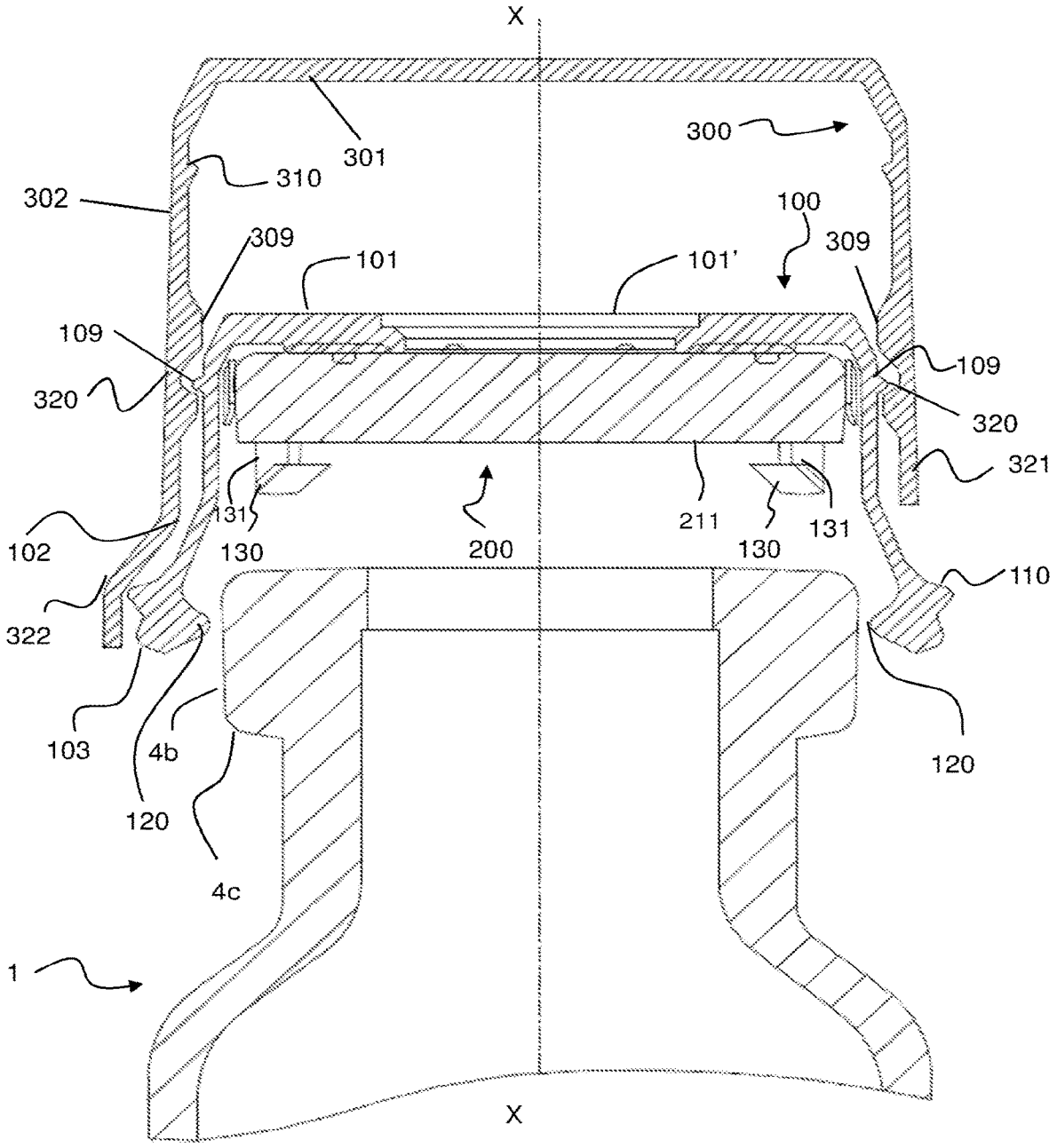
FIG. 5 shows, in a longitudinally sectioned larger-scale view, the closing assembly according to a second embodiment of the present invention, preassembled, at the start of the closing process.
Figure 6:
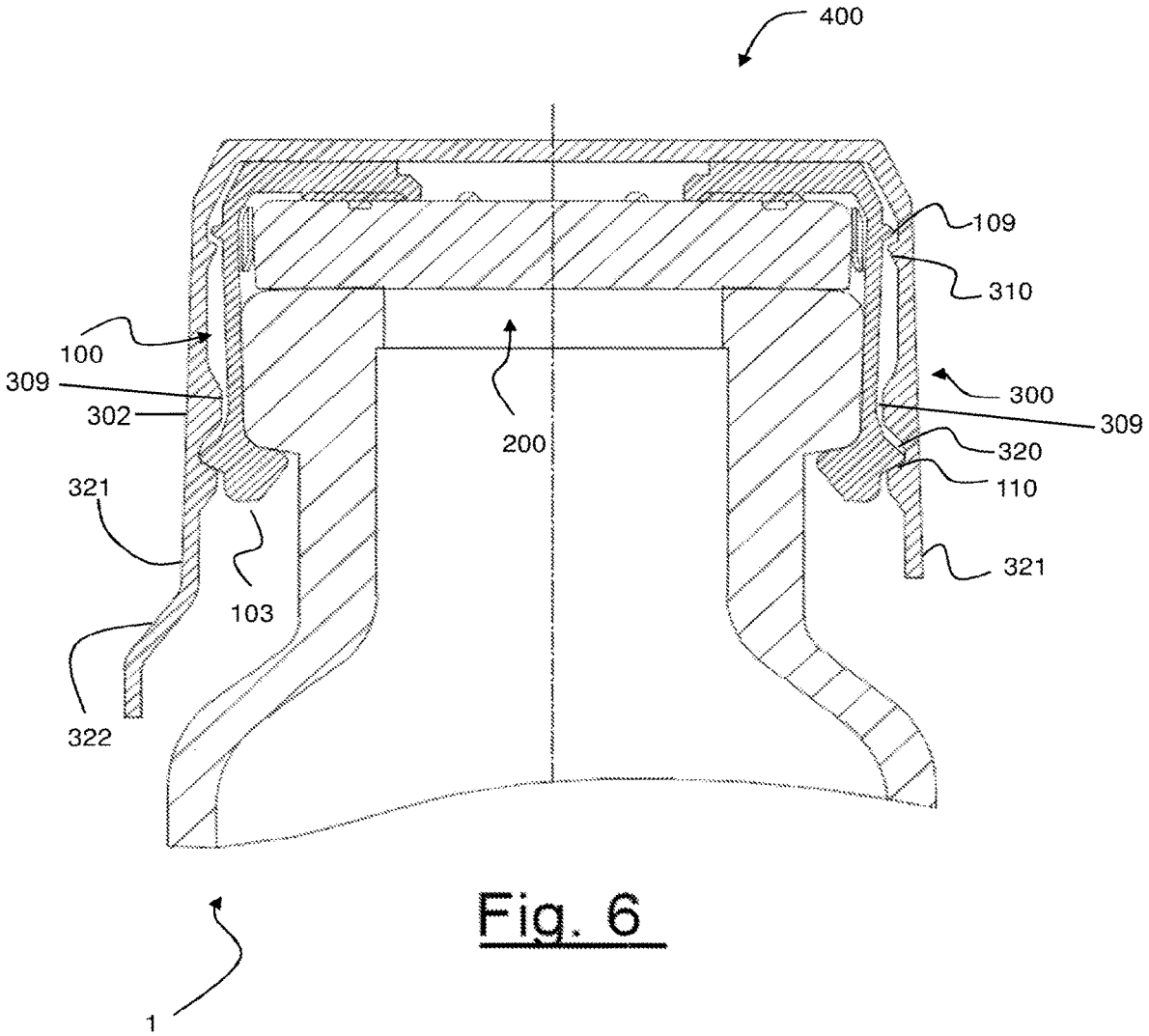
FIG. 6 shows, in a longitudinally sectioned larger-scale view, the closing assembly according to FIG. 5 at the end of the closing process.

FIGS. 5 and 6 show a variation of the closing assembly shown in FIGS. 2 and 3. The same reference numbers used for the first embodiment will be used and the detailed description will not be repeated. Essentially, the main difference relates to the capsule and the absence of the cap 400. The capsule itself acts as a cap. The capsule may be configured so as to be removable by means of tearing. Typically, this second embodiment is suitable for containing drinkable liquid substances and the stopper is formed solely by a disc without a shank.

The capsule 300 has preferably the shape of an overturned cup with an upper base which is closed and a side wall 302 which terminates in a free edge. Preferably, the capsule 300 is made of a plastic material, but could also be formed using a metallic material such as aluminium or aluminium alloy.

Preferably, the side wall 302 of the capsule 300 comprises an annular projection 310 and an annular cavity 320. The annular cavity 320 is configured to receive the upper spur 109 of the cage during an intermediate assembly step (FIG. 5). The annular projection 310 is configured to cooperate with the upper spur 109 of the cage during the final assembly step (FIG. 6).

Figure 7:
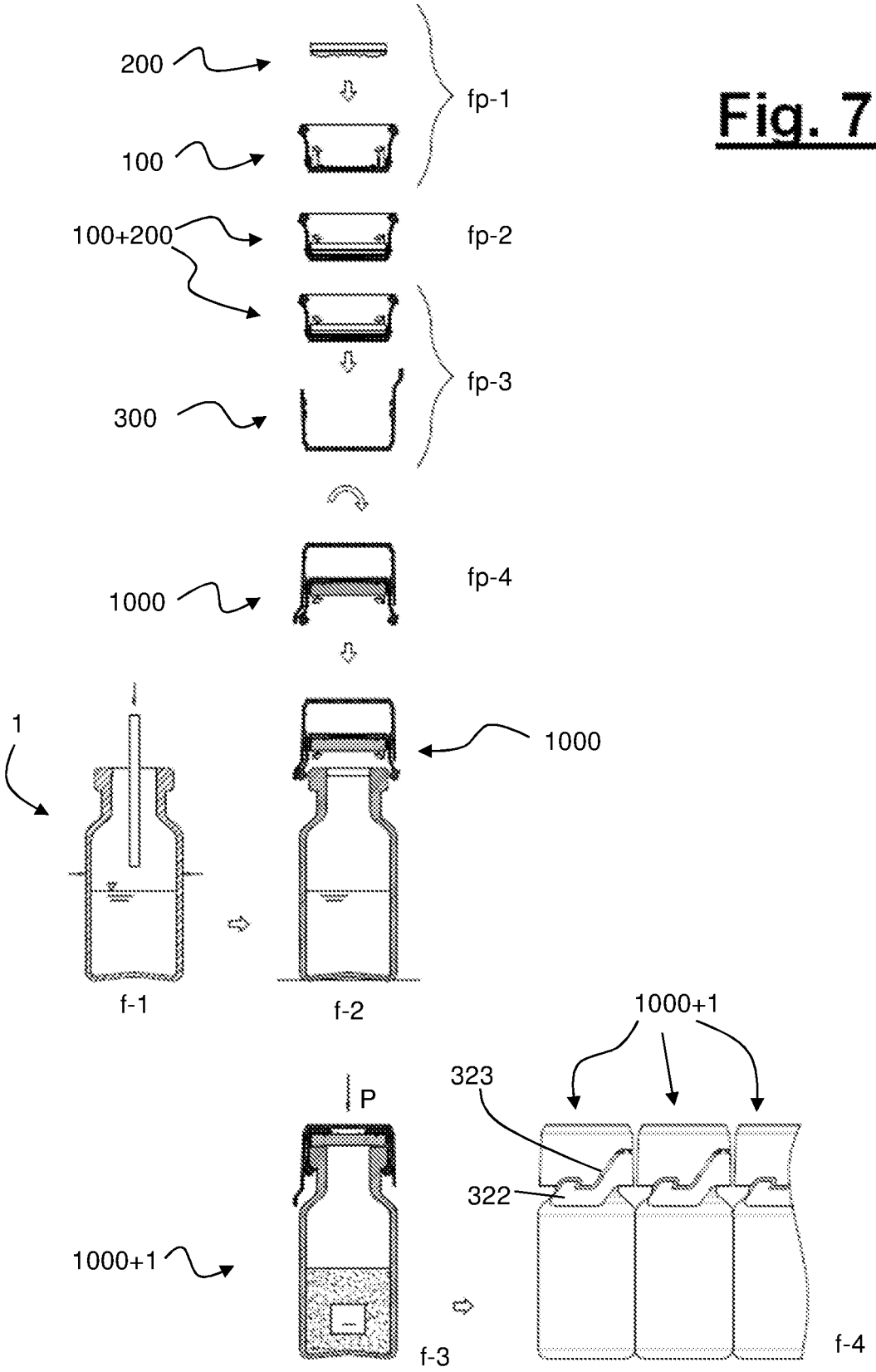
FIG. 7 shows the sequence of steps for preassembly of the closing assembly according to FIGS. 5 and 6, filling the bottle, and closing and transporting and/or storing filled bottles.

Preferably, at least one portion of the free edge of the capsule 300 is extended downwards, towards the body of the bottle. According to the embodiment shown in FIG. 6 and FIG. 7, the free edge is extended downwards with a straight section 321 along the entire perimeter of the capsule. Preferably, an outwardly angled tongue 322 is provided. This tongue is configured to be gripped between the fingers of a user and torn along a weakening line. In FIG. 7 an embodiment of the weakening line 323 is shown.

FIG. 7 shows one of the many ways in which the closing assembly according to FIGS. 5 and 6 may be preassembled and sealingly closed on the bottle. All the steps, both the preparatory steps and the assembly steps, are the same as those shown in FIG. 4 and will not be described again.

All the comments made in connection with the first embodiment are applicable to the second embodiment.

In general, the closing assembly described and shown may be easily used, by performing a small modification to all the filling and closing machines which exist today on the world market. The closing assembly in fact will be handled using the same structures (hopper, slides, etc.) which are used nowadays to convey only the rubber stopper for preassembly on the bottle, with modification of only a part of said structures depending on format.

The closing assembly moreover is such that it may be used on high-speed automatic machines and allows all the closing and sealing operations to be performed in a single operation with consequent savings in terms of costs, time, space, resources and personnel.

Finally, with the present closing assembly it is possible for any manufacturer to continue using their own closing stopper since said assembly is suitable for receiving any type of rubber stopper.

The invention claimed is:

1. A method for sealingly closing a bottle, the method comprising:

providing a cage, a closing stopper, and a capsule, wherein:

said cage is substantially cup-shaped and comprises a first side wall with an inner surface comprising an annular relief in the vicinity of a first free edge of the first side wall, the annular relief projecting radially inward at all times; and an outer surface comprising an upper annular spur and a lower annular spur, wherein the upper annular spur is in the vicinity of a closed base, the lower spur is substantially opposite to the annular relief, said capsule is cup-shaped and comprises a second side wall which terminates in a second free edge of the capsule, wherein said second side wall of the capsule comprises a first annular projection, a second annular projection, and an annular cavity, the first annular projection being adjacent and above the annular cavity, and the second annular projection being spaced from and at a height above the first annular projection, and the cage comprises an elastic retaining element for retaining the closing stopper in position, the elastic retaining element including one or more flexible, radially inward projecting retaining teeth;

joining the stopper to the cage, and the cage to the capsule, thus obtaining a preassembled closing assembly, wherein said joining comprises having the upper annular spur received in the annular cavity so that the cage is only partially inserted inside the capsule;

aligning the preassembled closing assembly on a mouth of the bottle and exerting a pressure so as to sealingly close the bottle, wherein the preassembled closing assembly is fitted onto the bottle in such a way that the annular relief of the cage presses elastically against a side surface of a collar of the bottle, and wherein the annular relief of the cage comes into contact with the side surface of the collar of the bottle before the stopper comes into contact with the bottle; and exercising a pressure directed downwards on the preassembled closing assembly such that the annular relief of the cage engages with the bottom surface of the collar, the annular cavity engages with the lower annular spur, the upper annular spur of the cage is above and adjacent to the second annular projection of the capsule, and the closing assembly remains locked to the bottle.

2. The method according to claim 1, wherein said joining comprises pushing the stopper towards a base of said cage, and forcing the one or more flexible, radially inward projecting retaining teeth of said elastic retaining element to retract inside a respective recess.

3. The method according to claim 1, wherein said annular cavity of the capsule may be disengaged from said upper annular spur of the cage by exerting pressure towards the bottom of the bottle.

4. The method according to claim 1, wherein said joining is performed by keeping the open base of the cage directed upwards.

5. The method according to claim 1, wherein a substance is introduced into said bottle before aligning the preassembled closing assembly on the mouth of the bottle and before exerting pressure so as to sealingly close the bottle.

6. The method according to claim 5, wherein said substance is a substance in the liquid state.

7. The method according to claim 1, wherein each of the annular relief, the lower annular spur, and the annular cavity are continuous around entire respective circumferences of the cage and the capsule.

8. A bottle sealingly closed according to the method as described in claim 1.

9. A bottle sealingly closed according to the method as described in claim 2.

10. A bottle sealingly closed according to the method as described in claim 3.

11. A bottle sealingly closed according to the method as described in claim 4.

12. A bottle sealingly closed according to the method as described in claim 5.

13. A bottle sealingly closed according to the method as described in claim 6.

* * * * *